US005870802A

United States Patent [19]

Goldman

[11] Patent Number: 5,870,802

[45] Date of Patent: Feb. 16, 1999

[54] BANDED PAPER CLIP

[76] Inventor: William A. Goldman, 3332 Middlefield Rd., Palo Alto, Calif. 94306

[21] Appl. No.: 925,997

[22] Filed: Sep. 9, 1997

[51] Int. Cl.[6] ..... A44B 21/00

[52] U.S. Cl. ..... 24/67.9; 24/67.11; 24/DIG. 11

[58] Field of Search ..... 24/67.3, 67.9, 24/67.11, 67 CF, 30 SL, DIG. 8–11, DIG. 28, 570, 530, 482, 459

[56] References Cited

U.S. PATENT DOCUMENTS

| | | | |
|---|---|---|---|
| 1,476,420 | 12/1923 | Romig | 24/67.9 X |
| 1,521,076 | 12/1924 | Clark | 24/67.11 |
| 1,997,894 | 4/1935 | Woodley | 24/67.11 |
| 4,055,874 | 11/1977 | Brown | 24/67.9 X |
| 4,286,358 | 9/1981 | Levin . | |
| 4,384,417 | 5/1983 | Thompson . | |
| 4,425,724 | 1/1984 | Scott | 24/67.9 X |
| 4,732,107 | 3/1988 | Jacobsen . | |
| 4,951,408 | 8/1990 | Banks . | |
| 5,398,384 | 3/1995 | Rinard | 24/67.9 |
| 5,481,784 | 1/1996 | Sinaiko | 24/DIG. 11 X |

FOREIGN PATENT DOCUMENTS

| | | | |
|---|---|---|---|
| 88259 | 1/1937 | Sweden | 24/67.9 |
| 12653 | 6/1896 | Switzerland | 24/67.11 |

*Primary Examiner*—Anthony Knight
*Assistant Examiner*—Robert J. Sandy

[57] ABSTRACT

An improved paper clip consisting of a wire clip integrally wrapped within a folded semi rigid banding allowing for the display of printed advertising, promotional, marketing, messaging or decorative indicia, in a multitude of shape and size, as suits the material displayed, while being easier to apply, and remove, while providing protection to the papers to which it is attached from crushing and tearing.

8 Claims, 5 Drawing Sheets

BANDED PAPER CLIP

BACKGROUND

1. Field of Invention

This invention relates to paper clips, and more particularly, an improved paper clip device that integrally incorporates the ability to display indicia in a plurality of size and shape as best suits the indicia displayed while improving the overall functionality of the paper clip in general.

2. Description of Prior Art

Paper clips in a myriad of constructions are known in the prior art. In its most ubiquitous form, the clip is a wire device formed of inter-nesting elongate wire loops. The prior art shows numerous devices that attempt to incorporate the ability to display indicia.

All previous attempts at including indicia in a clipping device have been awkward contrivances falling into two categories: adding an element to an existing clip design or a new clip design. Both approaches include some limited flat planar surface upon which limited indicia could be printed by limited printing production means.

All the prior art fails to achieve a format allowing flexibility of size, shape, and material so as to allow any indicia to be displayed to its best advantage. None of the prior art utilizes the standard wire clip in a manner that improves the functionality of the clip while providing the ability to display indicia attractively. None of the prior art has achieved any acceptance in the market place being either too expensive to produce or too awkward a contrivance to find widespread acceptance.

While all of the prior art allows the adequate retention of a various number of pages, none attempt the combined features of providing for the inclusion of promotional indicia in a multitude of shape and size as best suits the indicia displayed, enhance the ease of application, and removal as a clipping device, while protecting the clipped sheets from indentation from crushing or marring, and can be assembled either by hand or machine, while being economical to produce.

As in U.S. Pat. No. 4,286,358 to Levin, 1981 Sep., 1, or in part as in U.S. Pat. No. 4,951,408 to Banks, 1990Aug. 28, and other similar prior art, a separate manufactured element is either affixed to or added onto the standard paper clip as an added element. In U.S. Pat. No. 5,398,384 to Rinard, 1995 Mar. 21, and other similar prior art, the attempt is manifested as a new paper clip design and configuration.

None of the prior art provides the flexibility, economy and ease of use of the present invention. No prior art has the flexibility to display indicia in a variety of size and shape. None of the prior art utilizes a wire paper clip in combination with an integrally wrapped band utilizing the characteristics of the wire paper clip to improve the functionality of the combination. None of the prior art is able to provide the means for a variety of size, shape, and material, so that any given end user can have indicia incorporated that is consistent with what they are utilizing in other printed media.

OBJECTS AND ADVANTAGES

Accordingly, besides the objects and advantages of the banded paper clip described in my above patent, several objects and advantages of the present invention are:

(a) to provide a paper clip having means with which advertising, promotional, marketing, decorative or message indicia can be displayed, but wherein such means does not interfere with normal clip operation.

(b) to provide the ability to incorporate printed indicia of various size and shape as suits the end user so as to display their printed indicia in the most attractive and effective manner.

(c) to enhance the ease of applying and removing a paper clip device.

(d) to prevent the marring of papers the clip is applied to, protecting said papers from marring indentation from crushing in use, or the possibility of marring by tearing in removal of the clipping device.

(e) to provide the ability to utilize a multitude of material to which printed indicia may be applied and incorporated.

(f) to provide an inexpensive means of promotion of any company, product, product line, corporate entity, goal, or idea.

(g) to provide a practical means to extend the uses and functionality of the common paper clip.

(h) to provide, via alteration of dimensions of the banding and folding of same, the added ability to utilize the present invention as a removable positionable indexing tab, clipable page marker, free standing card holder, or free standing clipable display card.

Further objects and advantages are to provide a novel means to display any printed indicia as an integral element of a functional device, at low cost, with ease of fabrication either by hand or machine. Still further objects and advantages will become apparent from a consideration of the ensuing description and drawings.

DRAWING FIGURES

REFERENCE NUMERALS IN DRAWINGS

Figure 1:
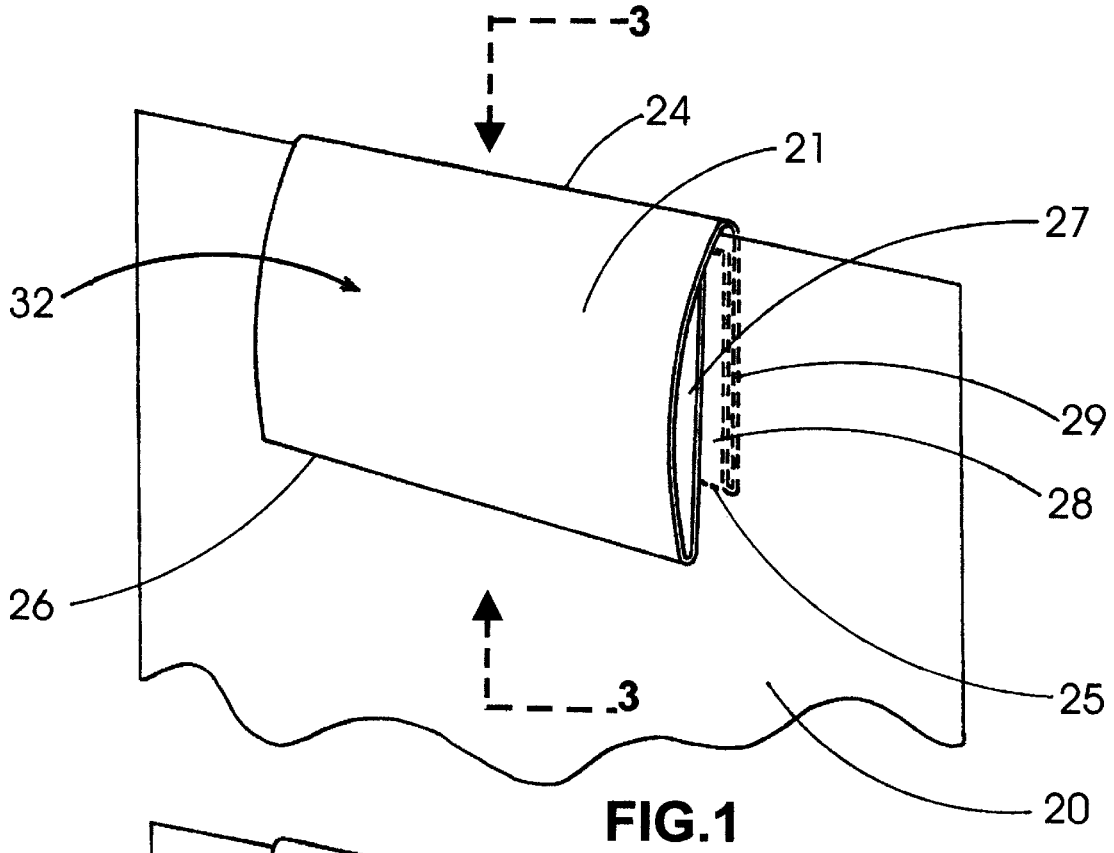
FIG. 1 shows a frontal view of the preferred embodiment of the invention in use.

20 clipped material
20*a* clipped material
21 front printable face
21*a* modified portion of front printable face plane
22 wire paper clip
23 gap
24 fold
24*a* fold
24*b* fold
25 fold
26*a* fold
26*b* fold
27 clip leg from front printable face plane
28 clip leg from back printable face plane

29 back printable face plane
29*a* back printable face plane extended (in an additional embodiment)
29*b* back printable face extended (in an additional embodiment) as front printable face
32 the invention
32*a* an additional embodiment.
32*b* another additional embodiment.

SUMMARY

In accordance with the present invention an integrally banded wire paper clip providing means for the incorporation of printed indicia on a multitude of printable materials, in a multitude of size and shape.

Figure 2:
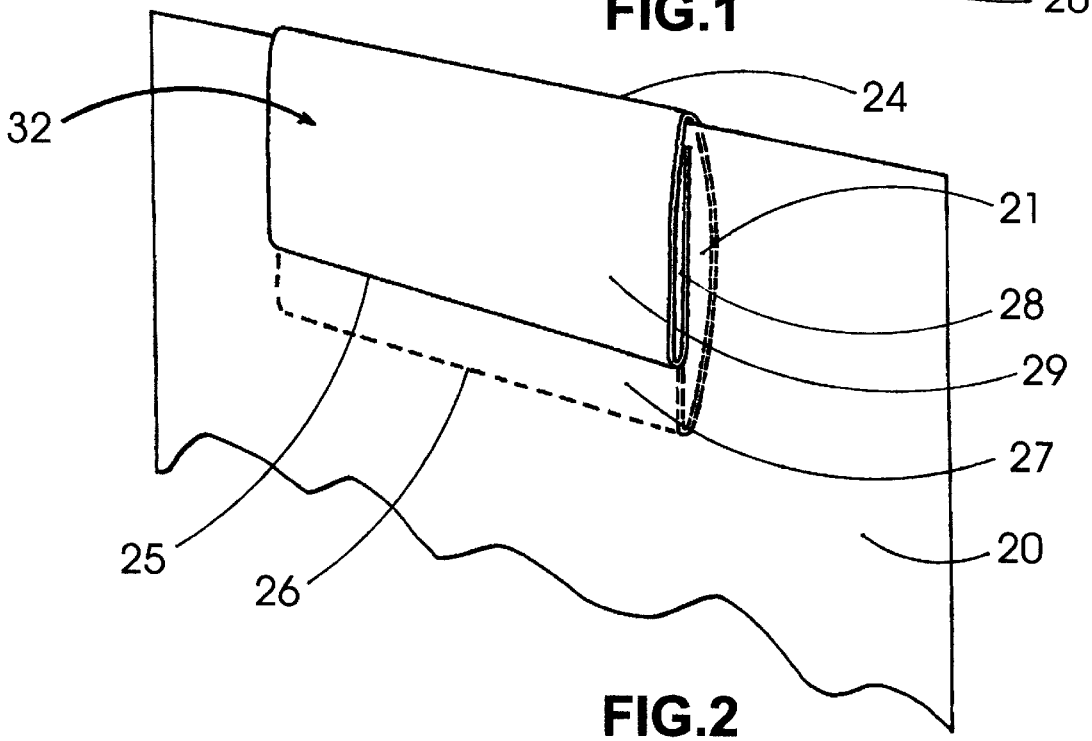
FIG. 2 shows a back view of the preferred embodiment of the invention in use.
Figure 3:
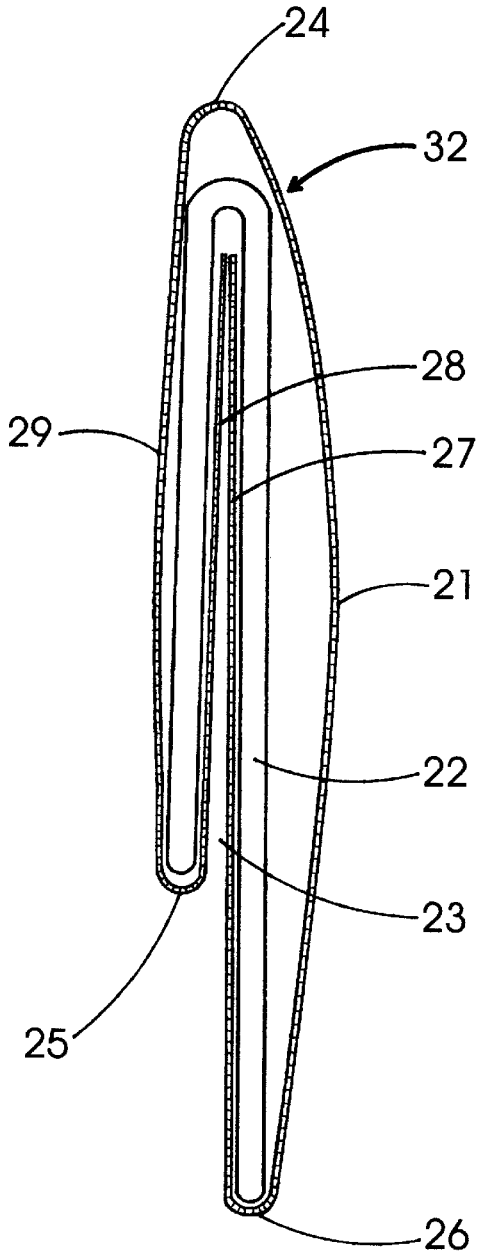
FIG. 3 shows a sectional view.

Description—FIGS. 1–3

A typical embodiment of the banded clip of the present invention is illustrated in FIG. 1 (front view), FIG. 2 (back view), and FIG. 3 (sectional view).

The present embodiment consists of a standard wire paper clip 22 and a continuous band of any printable material of a thickness, weight, and folding characteristics approximating that of a standard business card. The clip has a printable front face plane 21 that may be configured in a multitude of size and shape and can accommodate standard printing including embossing and die cut shapes (FIGS. 10–12), a back printable face plane 29 that may also display printed indicia, a series of folds or creases 24, 25, 26 that lock a wire paper clip 22 in place, and form the two legs of the band, clip leg 27, and clip leg 28. The two legs 27, 28 terminate at the interior of the upper U shape of the wire clip 22 forming a V shaped void 23 by the marginal deformation of the wire paper clip 22 allowing for ease of application to sheets to be clipped and removal from same. Thus, this configuration entirely wraps all of the planar surfaces of the encased wire paper clip 22. By altering the length of the front printable face plane 21 the clip can be configured with a domed dimensionality. Additionally, by increasing the front printable face plane 21 dimension further, and introducing an additional crease FIGS. 11-24*a* forming 21*a* ( a modified portion of front printable plane ) wedge like dimension can be created.

Figure 4:
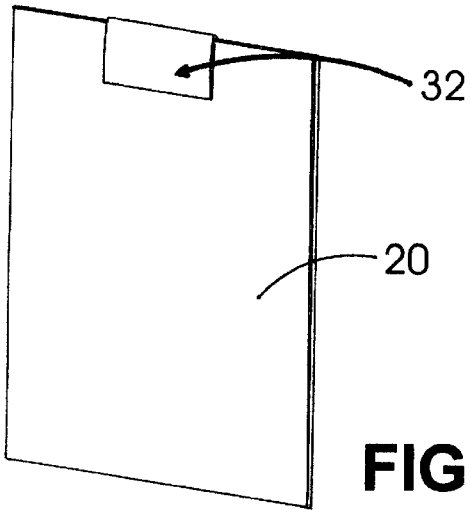
FIGS. 4,5,6 show several variations of the present embodiment of the invention in use.
Figure 5:
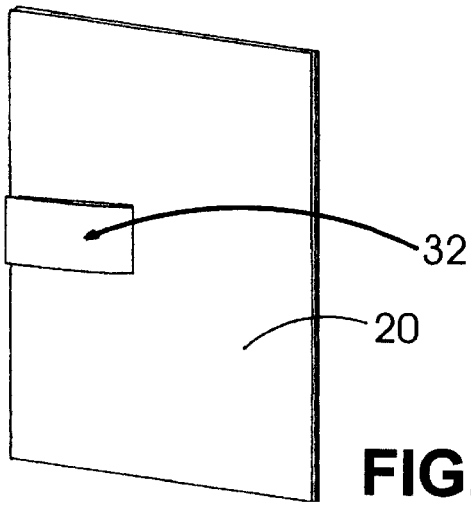
Figure 6:
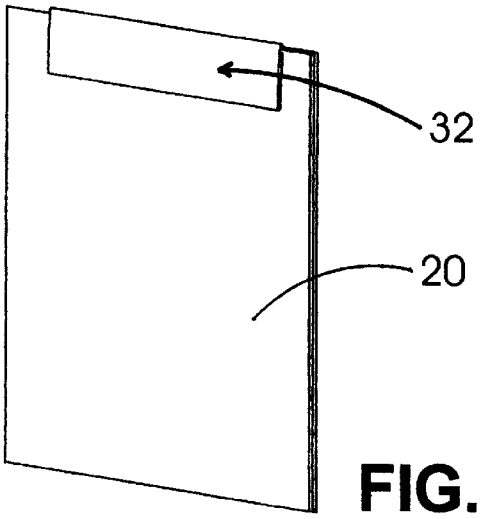

Description—FIGS. 4–6

FIGS. 4–6 depict the typical embodiment of the banded clip 32 in typical use ( clipping a group of papers 20), with a suggestion of the plurality of size, shape FIG. 4-32 (also as in FIG. 10-32, FIG. 11-32, FIG. 12-32), FIG. 6-32 and application FIGS. 5–32, FIG. 10-32 possible within the present embodiment of the invention. These figures FIGS. 4–6 depict several, of the multitude of variations of the present embodiment possible, and should not be construed as limitations on the scope of the invention.

Figure 7:
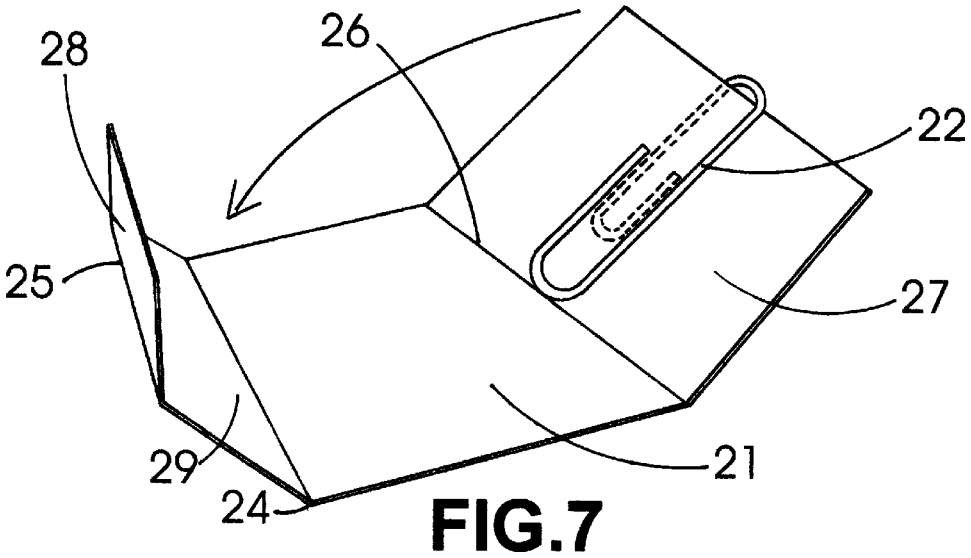
FIGS. 7,8,9 show the steps required to fabricate the preferred embodiment of the invention.
Figure 8:
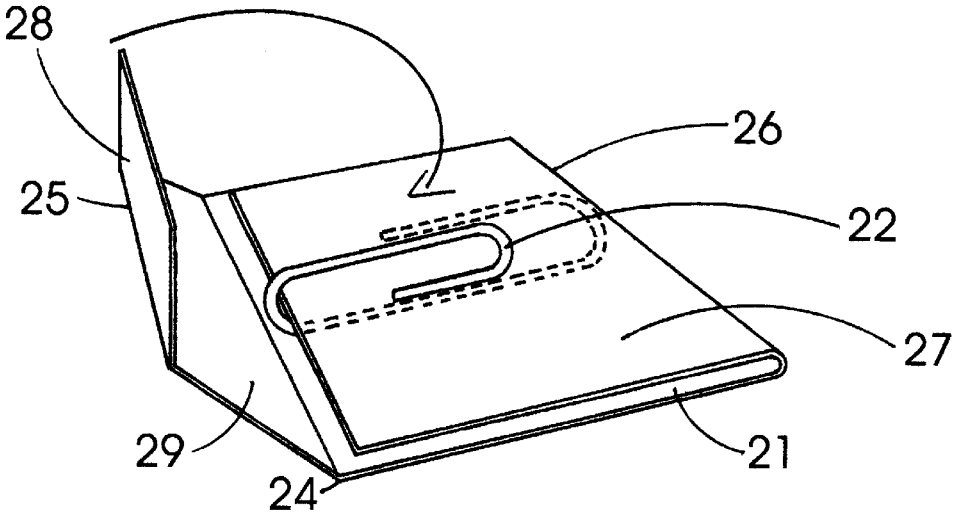
Figure 9:
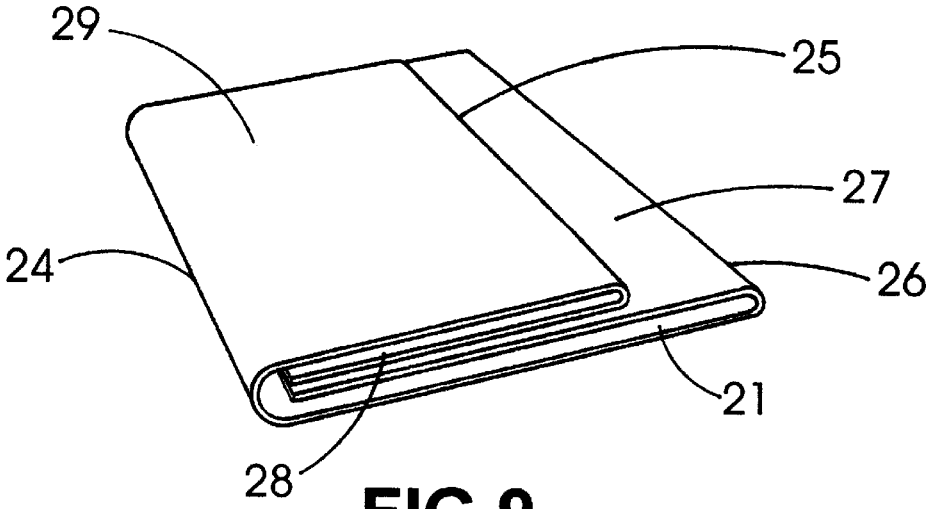

Description—FIGS. 7–9

The fabrication of the present invention, either by hand, or machine, begins (FIG. 7) by fully inserting a wire paper clip 22 onto clip leg 27. Clip leg 27 to be of a predetermined length so that when the clip is fully inserted, it bottoms out at fold 26. Clip leg 27 with the clip 22 now attached is folded forward as the arrow in FIG. 7 indicates to the back side of front printable face plane 21 as depicted in FIG. 8. Back printable face plane 29 is folded forward utilizing fold 24 as the arrow in FIG. 8 indicates, and clip leg 28 is tucked in over the remaining exposed portion of the wire clip 22 adjacent to leg 27 and bottoming out at the same point as leg 27 completely encasing the wire paper clip 22 and completing the assembly (FIG. 9). For rapid assembly by hand, an additional fold can be added to divide plane 28, to expedite the tucking in of this leg.

Figure 10:
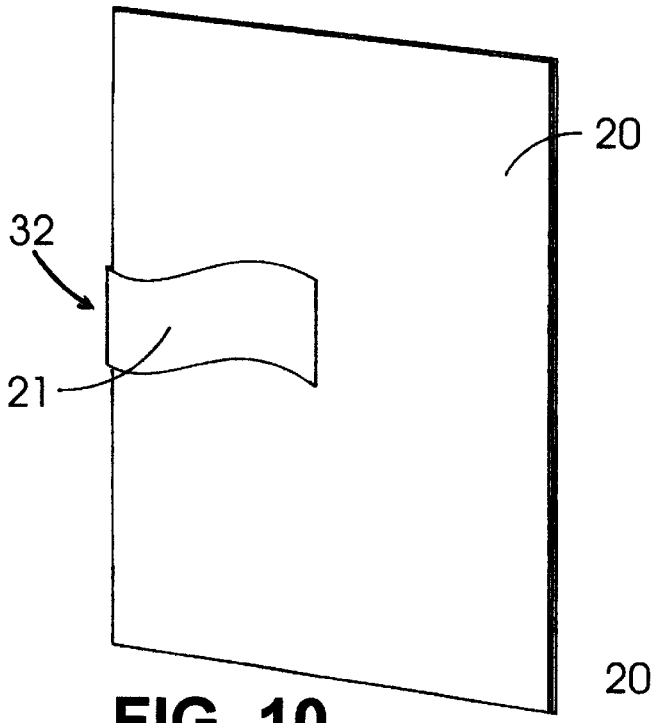
FIGS. 10,11,12 show several further variations possible with the preferred embodiment.
Figure 11:
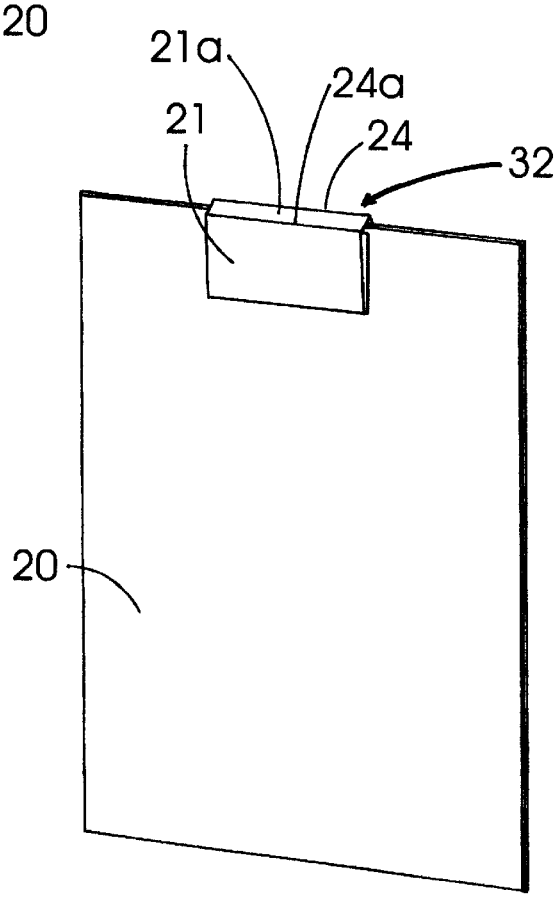
Figure 12:
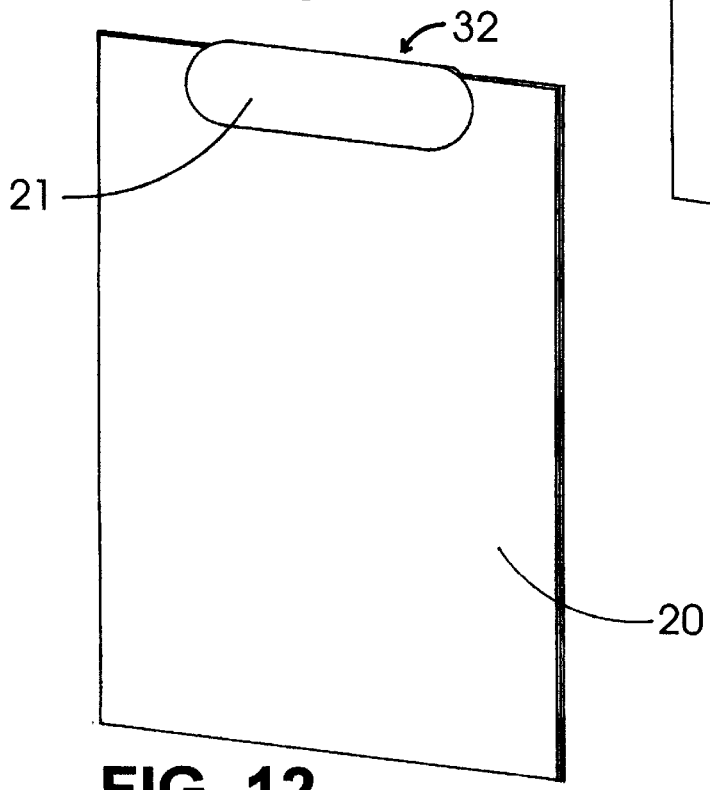

Description—FIGS. 10–12

FIG. 10 depicts the preferred embodiment of the banded paper clip 32 in use clipping a group of papers 20 with the front printable face plane 21 in a predetermined die cut shape.

FIG. 12 depicts the preferred embodiment of the banded paper clip 32 in use clipping a group of papers 20 with the front face plane in another of a multitude of predetermined die cut shapes.

FIG. 11 depicts the preferred embodiment in use clipping a group of papers 20 with the overall length of the banding increased a predetermined amount. This allows for the addition of fold 24*a* creating a modified portion of front printable face plane 21*a* yielding a wedge shape dimension to the preferred embodiment 32.

Figure 13:
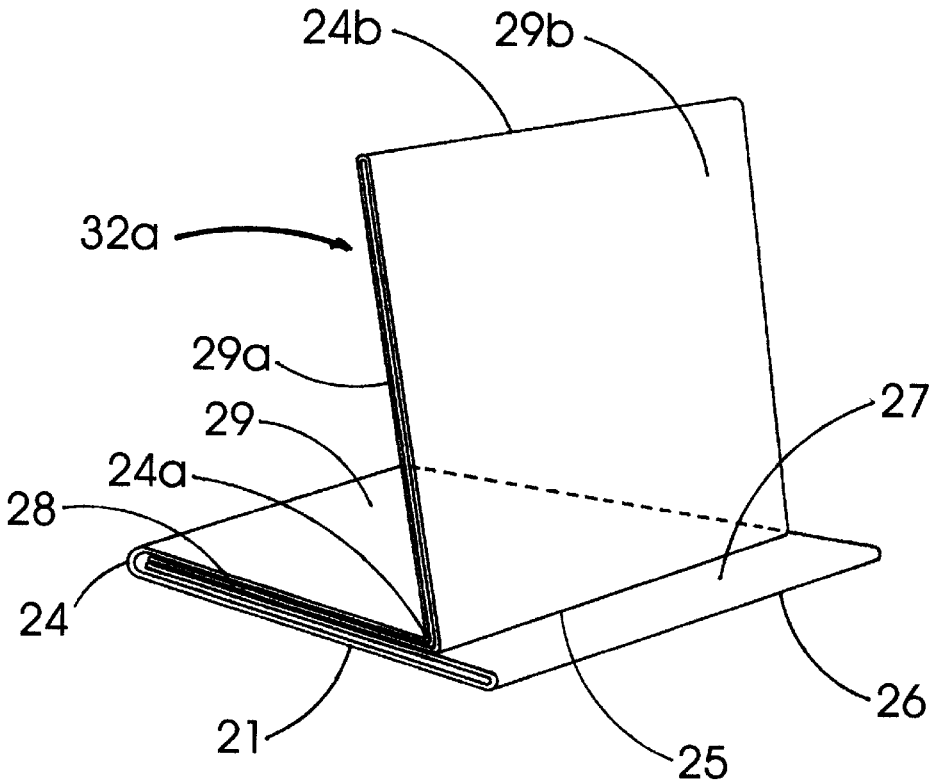
FIG. 13 shows an additional embodiment of the present invention
Figure 14:
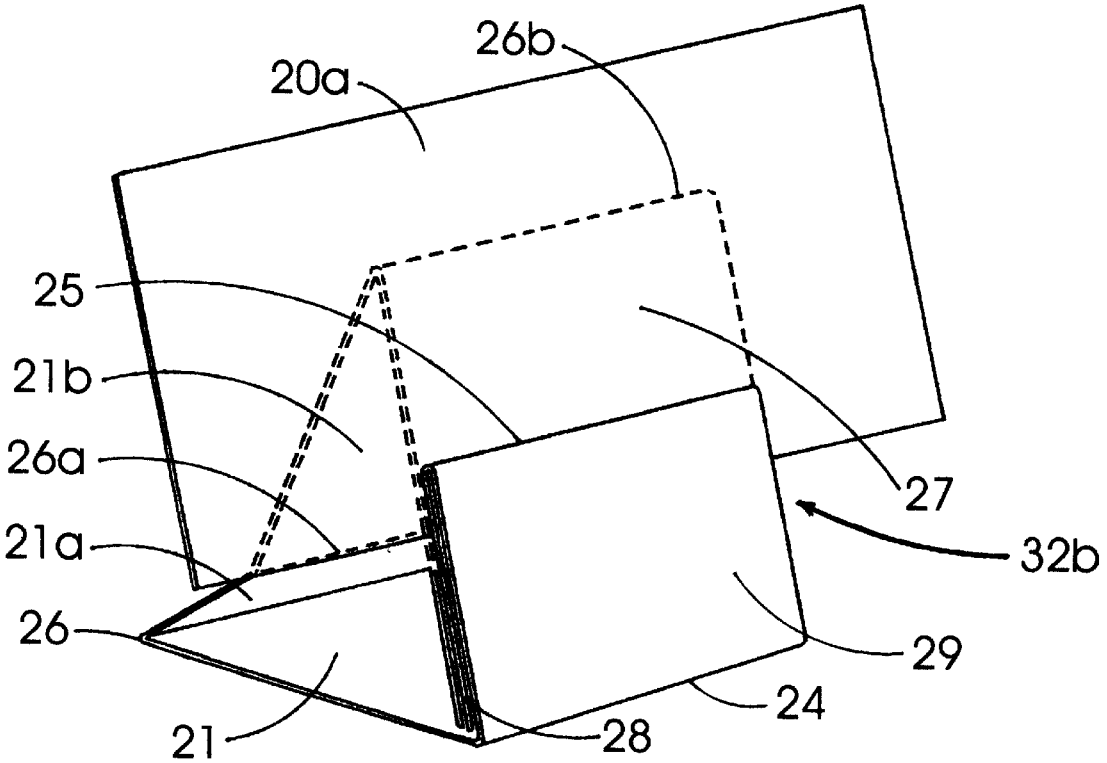
FIG. 14 shows a further additional embodiment of the present invention.

Description—FIGS. 13, 14

FIG. 13 depicts another embodiment of the invention in which the overall dimensional length of the banding has been increased (to a predetermined length) with several added folds 24*a*, 24*b* resulting in embodiment 32*a* as depicted, with back printable face extended as front printable face 29*b*. This particular embodiment is ideally suited for use as preprinted banquette place markers, or permanent display cards, or utilized (more in keeping with the preferred embodiment) as a clipable game marker for a traveling game board or other applications that the embodiment and figure suggest. In such use, one could easily envision plane 29*b* FIG. 13 with an appropriate printed, and die cut figure, against a printed inner face of 29*a* creating an inexpensive, visually dimensional game piece. This embodiment 32*a* is achieved by extending the length of the overall banding to a predetermined length, adding fold 24*a*, and fold 24*b* which form plane 29*a*. The remainder of the banding is tucked back into the clip at fold 25 becoming clip leg 28 and completing the assembly. That which had been the printable face 21 referred to in FIGS. 1–9 now becomes the base for this embodiment, creating a stable, free standing display card that can still be utilized as a clipping device depending on the needed end use.

FIG. 14 depicts another embodiment of the invention 32*b* achieved as in FIG. 13 by extending the overall length of the banding material to a predetermined length. Fold 26*a*, and fold 26*b* are added, clip leg 27 is tucked back into the paper as in the preferred embodiment. Although the embodiments as depicted in FIG. 13 and FIG. 14 result in configurations substantially different in appearance and possible function from the preferred embodiment, the fabrication is identical to the preferred embodiment as depicted in FIGS. 7–9.

Operation—FIGS. 1–6

Operation of the preferred embodiment as illustrated in FIGS. 1–6 allows for a front printable face plane 21 to display preprinted advertising, promotional, identification, or messaging indicia of any variety, color, and complexity, utilizing any of the myriad of printing methodologies available, and displaying the material so printed upon front printable face plane 21 of a size and shape suitable for the printed material, providing the ability for a look and feel consistent with that utilized by the end user in other printed media. The ability to maintain a consistent image to which a company logo or message is involved is of no small matter to those involved in crafting and maintaining an advertising campaign or corporate image program.

Back printable face plane 29 can also contain indicia, where deemed appropriate by the end user, and, or, the company logo, address, and phone number of the manufacturer of the banded clip.

The deformation of the underlying wire paper clip created by clip leg 27, and clip leg 28 as noted on FIG. 3 which forms a V shaped gap 23, holds the banding in place by the urging of the wire paper clip. The V shaped gap FIGS. 3–23 allows the clip to be applied to a group of papers with greater ease than the standard paper clip. The gap 23 eliminates any need to deform the clip to apply it as is the case with the wire paper clip. Clip legs 27 and 28 protect the clipped papers from the possibility of marring by crushing indentation, as is common with a standard paper clip, as well as eliminating the possibility of tearing, or gauging the clipped papers in removing the clip, since the sharp edges of the wire clip 22 are encased by leg 27 and 28 in the fabrication of the banded clip.

Theory of Operation

The banded paper clip, even in extreme dimensions (as depicted in FIG. 6) adds gripping ability throughout the width of the configuration. The embodiment seems to have a gripping ability surpassing that of a standard wire clip. While I believe this occurs because the slight deformation of the wire clip 22 in fabrication with it's banding, creates a tension that is transferred to the semi rigid banding. The manner in which it is folded, and the semi rigid nature of the banding magnifies this tension throughout it's width, I don't wish to be bound by this.

The flexibility of choice in final shape, size, and of banding material that the preferred embodiment permits would suggest that operation of the embodiment in terms of how, why, and were, the embodiment is to be utilized would extend beyond the common operation and application of the standard wire paper clip. The preferred embodiment would operate as much a promotional and marketing means as a clipping device.

The embodiments as illustrated in FIG. 13-32*a*, and FIG. 14-32*b* and as described in Description of FIGS. 13, 14 clearly suggest that by the predetermined extension of the overall length of the banding material, and this extra length used to form plane 29*a* and 29*b* with the addition of folds 24*a* and 24*b* as in FIG. 13 yield an embodiment that could operate as a free standing display marker, clipable game piece for a traveling game board, or a clipable standing tabbing device would allow the preferred embodiment to function as other than a clipping device, such as a clipable relocatable tabbing device, a clipable book mark, a free standing display marker, a clipable game marker, or a clipable standing tab. Further predetermined extension of the overall band length with the additional length applied to increasing the length of face 29*a* and 29*b* would allow the embodiment to function as a clipable bookmark. The operation of clip legs 27, 28 would be similar to the operation of these elements as described in the preferred embodiment 32.

The embodiment of the invention as depicted in FIG. 14-32*b* alters the overall function of the fabrication from a device that is applied, to a device that receives. In such an embodiment, the operation of front face 21 of the original embodiment is now utilized as a base, and the extended predetermined length of this element with the addition of a fold 31, functions as the back of this embodiment. The encasing of the underlying wire paper clip in the embodiments as depicted in FIGS. 13, 14 in all other respects, remains unaltered, as does the basic steps of fabrication as depicted in FIGS. 7–9.

Conclusion, Ramifications, and Scope

Accordingly, the reader will see that the banded paper clip of this invention provides additional functionality to the paper clip allowing printed advertising, promotional, product, corporate, marketing, messaging, or decorative indicia of a shape, size, and placement, in design and use, as best suits the goals of the user, as an integral, functional part in a fabrication that enhances the general ease of use as a clipping device, and provides protection for the pages to which it is attached. Furthermore, the banded paper clip has the additional advantages in that

- it permits the inclusion of printed indicia at little cost, utilizing standard printing methodologies with ease of fabrication either by hand or machine.
- it permits the paper clip to expand it's functions and usefulness, for business, government, or personal use, becoming a functional promotional, informative, or decorative device offering a great flexibility of visual design.
- it provides a novel means for a business to display advertising, promotional, corporate, or messaging, or decorative indicia.
- it creates a new, low cost, medium for the advertising community heretofore unavailable or impractical.
- it allows for colorful, attractive, informative attachments to be included in an integrated, functional manner making any group of clipped papers more interesting visually, and more informative for the end reader.
- it permits, in the simplicity of overall design, the ability to create additional embodiments whose form and function greatly extend the application and usefulness of the invention.

Although the description above contains many specificities, these should not be construed as limiting the scope of the invention but as merely providing illustrations of some of the presently preferred embodiments of this invention. For example, the banding material of the invention could be of a non printable type such a textured metal, plastic, mirrored, metal stranded, photographic, laminated, or other sheet material containing the characteristics required for fabrication.

Thus the scope of the invention should be determined by the appended claims and their legal equivalents, rather than by the examples given.

I claim:

1. A method of banding a wire paper clip comprising:

a. providing a band of semi-flexible foldable material of predetermined length and width, having a predetermined number of creases at predetermined dimensions for folding, b. inserting a wire paper clip of predetermined size to one end of said band of semi-flexible foldable material, ending at a first of said creases, c. folding said band of semi-flexible foldable material over on itself at said first crease, d. folding said band of semi-flexible foldable material over on itself again at a next one of said creases, e. folding an opposite end of said band of semi-flexible foldable material over a remaining exposed portion of said wire paper clip, and f. tucking said end into a gap formed between said wire paper clip, and a first fold of said band of semi-flexible foldable material, bottoming out at an adjacent point of an opposing end of said band of semi-flexible foldable material, thereby completing a final fold; and whereby said wire paper clip is held in place by said band of folded semi-flexible foldable material, and said band of folded semi-flexible foldable material is held in place by the urging of said wire paper clip.

2. The method of claim 1 wherein said band of semi-flexible foldable material is pre-printed.

3. A method of displaying indicia as an integral part of a paper clipping device comprising:

a. providing a band of pre-printed semi-flexible foldable material of predetermined length and width having a predetermined number of creases at predetermined dimensions for folding, b. inserting a wire paper clip of predetermined size to one end of said band of pre-printed semi-flexible foldable material, ending at a first one of said creases, c. folding said band of pre-printed semi-flexible foldable material over on itself at said first crease, d. folding said band of pre-printed semi-flexible foldable material over on itself again at a next one of said creases, e. folding an opposite end of said band of pre-printed semi-flexible foldable material over a remaining exposed portion of said wire paper clip, f. tucking said end of said band of pre-printed semi-flexible foldable material into a gap formed between said wire clip, and first fold of said pre-printed band of semi-flexible foldable material, bottoming out at an adjacent point of an opposing end of said band of pre-printed semi-flexible foldable material, thereby completing a final fold; and whereby said wire paper clip is held in place by said band of folded pre-printed semi-flexible foldable material, and said band of folded pre-preprinted semi-flexible foldable material is held in place by the urging of said wire paper clip.

4. In combination:

a. a wire paper clip of predetermined size; and b. a band of semi-flexible foldable material of predetermined length and width, having a predetermined number of creases for folding at predetermined dimensions, said creases defining a front printable face plane surface, a back printable face plane surface, and two clip legs, providing a means for insertion of said wire paper clip to one of said clip legs, said wire paper clip bottoming out at a first one of said creases, said band of semi-flexible foldable material folded upon itself twice, a remaining one of said clip legs folded over an exposed portion of said wire paper clip, said remaining clip leg tucked into a gap formed between said exposed portion of said wire paper clip and a first fold formed by the first cease, bottoming out at an adjacent point to the first clip leg, thereby completing a final fold;

whereby said band of folded semi-flexible foldable material is held in place by the urging of said wire paper clip, and said wire paper clip is held in place by said folding of said band of semiflexible foldable material, and said folded band of semi-flexible foldable material of said combination protects any material it is applied to from contact with said wire paper clip.

5. The device of claim 4 wherein said band of semi flexible-foldable material is pre printed.

6. The device of claim 4 wherein said band of semi flexible-foldable material is of a different predetermined length.

7. The device of claim 4 wherein said band of semi-flexible foldable material contains a predetermined number of additional creases for folding at predetermined dimensions.

8. The device of claim 4 wherein said front printable face plane surface is a predetermined shape differing from said predetermined width of said band of semi-flexible foldable material.

* * * * *